US006459377B2

(12) United States Patent
Sakai et al.

(10) Patent No.: US 6,459,377 B2
(45) Date of Patent: Oct. 1, 2002

(54) ABNORMAL CONDITION DETECTING SYSTEM DETECTING ABNORMAL CONDITION OF USER AT RESIDENCE

(75) Inventors: Tatsuya Sakai, Shijonawate; Takashi Otsuki, Nara, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/895,393

(22) Filed: Jul. 2, 2001

(30) Foreign Application Priority Data

Jul. 14, 2000 (JP) ..... 2000-214537

(51) Int. Cl.[7] ..... G08B 13/14

(52) U.S. Cl. ..... 340/573.1; 340/3.43; 340/511; 340/825.36; 340/628; 340/661

(58) Field of Search ..... 340/573.1, 825.36, 340/3.1, 3.43, 628, 603, 627, 657, 600, 661, 511, 538

(56) References Cited

U.S. PATENT DOCUMENTS

| | | | | |
|---|---|---|---|---|
| 4,417,235 A | * | 11/1983 | Del Grande | 340/531 |
| 5,428,342 A | * | 6/1995 | Enoki et al. | 340/511 |
| 5,914,658 A | * | 6/1999 | Arakawa | 340/568.8 |
| 6,249,221 B1 | * | 7/1999 | Reed | 340/539 |

FOREIGN PATENT DOCUMENTS

| | | | |
|---|---|---|---|
| JP | 59-220893 | | 12/1984 |
| JP | 08-168087 | * | 6/1994 |
| JP | 6-317368 | | 11/1994 |
| JP | 7-180447 | | 7/1995 |
| JP | 7-293072 | | 11/1995 |
| JP | 11-86168 | * | 9/1997 |
| JP | 01-67576 | * | 8/1999 |

* cited by examiner

*Primary Examiner*—Jeffery Hofsass
*Assistant Examiner*—Daniel Previl
(74) *Attorney, Agent, or Firm*—Nixon & Vanderhye P.C.

(57) ABSTRACT

From a parameter setting unit, a user enters values for monitor start time (STime), check time (ETime) and a telephone number for notification (TelNo). The entered parameter values are stored into a storage unit. A door opening/closing detection unit detects opening/closing of e.g. a bathroom door. During the period from STime to ETime, the number of detections is counted and if the counted value is at most a predetermined value, it is determined as abnormal. When the abnormality is detected, a communication unit is automatically connected via a general public line to TelNo set by the user. A telephone to be notified is then notified of the abnormal condition of an inhabitant. Thus, an abnormal condition detecting system can be provided capable of appropriately detecting the abnormal condition of the inhabitant and promptly taking action thereon.

19 Claims, 11 Drawing Sheets

ABNORMAL CONDITION DETECTING SYSTEM DETECTING ABNORMAL CONDITION OF USER AT RESIDENCE

BACKGROUND OF THE INVENTION

1. Field of the Invention

The present invention relates to an abnormal condition detecting system, and particularly, to an abnormal condition detecting system detecting an abnormal condition of a user at his/her residence by monitoring the frequency of use of a home infrastructure (basic life equipment) in the residence.

2. Description of the Background Art

The simplest way of monitoring the use frequency of a home infrastructure (basic life equipment) installed in a residence, such as a bathroom or a refrigerator, is to detect opening and dosing of a door (the door of a bathroom, the door of a refrigerator or the like).

Technologies for detecting or monitoring opening and closing of a door are disclosed, for example, in Japanese Patent Laying-Open No. 59-220893, Japanese Patent Laying-Open No. 7-293072, Japanese Patent Laying-Open No. 7-180447 and so forth. Japanese Patent Laying-Open No. 59-220893 describes an apparatus for surely monitoring a doorway to an important area by detecting and monitoring opening/dosing of a door and the check-out period of a key. Moreover, Japanese Patent Laying-Open No. 7-293072 describes a technology related to a controlled access system that monitors entrance and exit of a person from/to each room in a building by detecting opening/closing of a door. Furthermore, Japanese Patent Laying-Open No. 7-180447 describes a technology related to an apparatus for opening/closing a garage door using a remote control, which is directed to safe guiding of a car into the garage at the time of parking.

In addition, an example of a technology for monitoring abnormality of various home infrastructures such as gas, water and electricity, irrespective of opening/dosing of a door, is disclosed in Japanese Patent Laying-Open No. 6-317368. In the disclosure, a technology related to a simple remote monitoring system of an air conditioner utilizing a communication device for a micon gas meter or the like is described.

In recent years, the number of senior citizens who live alone without any relatives or acquaintances in the neighborhood has increased with declining birthrate, trend toward the nuclear family, improved life expectancy and so forth, raising social problems. There are some cases such that an aged person who lives alone falls down at home without nobody noticing for a long period of several days to several months, or that a neighbor who became suspicious visits such an aged person only to find him/her already passed away.

In order to solve such problems, the national and local governments have been trying to reinforce social welfare systems. Moreover, many private enterprises have been participating in social works such as a helper-leasing business.

However, such social welfare systems and services have not been satisfactory for solving the problems described above. This is because the national and local governments run such social services mainly for physically-handicapped and seriously-ill people in view of welfare budget. Therefore, senior citizens who merely live alone without any relatives have necessarily been given lower priorities and thus have not been able to receive appropriate services.

On the other hand, the fee for helpers provided by private enterprises are expensive. In addition, people who live alone generally tend to refuse strangers entering their home. Therefore, such social services provided by private enterprises have been utilized only in special cases where a person has difficulty in spending daily life or where a person lives with somebody and hence has no anxiety for a stranger coming into his/her home.

Thus, there has been a need for development of a technology for supporting the lives of senior citizens living alone and reassuring them in some way, not depending on the government welfare systems or the private social services.

However, the conventional technologies described earlier were developed mainly for the purpose of assuring security rather than for supporting people living alone in case of emergency. Thus, the conventional technologies could not deal with abnormal circumstances of people living alone and thus were no solutions to the problems described above.

SUMMARY OF THE INVENTION

Therefore, an object of the present invention is to provide an abnormal condition detecting system that can appropriately detect an abnormal condition of an inhabitant and that can take prompt action thereon.

The object of the present invention described above can be achieved by an abnormal condition detecting system having features described below. According to an aspect of the present invention, an abnormal condition detecting system includes an acquisition unit acquiring information related to use of a home infrastructure in a residence; a count unit counting the number of uses of the home infrastructure during a certain time period starting at every predetermined interval, based on the acquired information related to use; a determination unit determining whether or not the counted number of uses is at most a predetermined value; and a recognition unit recognizing an abnormal condition of a user using the home infrastructure when the determination unit determines that the counted number of uses is at most a predetermined value.

According to the present invention, the number of uses of the infrastructure within a certain period beginning at every predetermined interval is counted, for example, on a daily or weekly basis. Then, if the counted number of uses is no higher than a predetermined value, it is recognized that the user (inhabitant at the residence) using the infrastructure is in an abnormal condition. The number of uses is counted at predetermined intervals in view of the life cycle of the user, so that such an abnormal condition can be more appropriately determined based on the counted number.

Therefore, an abnormal condition detecting system that can appropriately detect an abnormal condition of an inhabitant and that can take prompt action thereon may be provided.

Preferably, the certain period is shorter than the predetermined interval.

Accordingly, the time period for which the number of uses of the infrastructure is counted (a certain period) is made shorter, and hence there is a time period for which no counting is performed. Thus, certain time with lower possibilities of counting may be excluded from the counting period (a certain period), for example, by leaving the time at which the inhabitant is often out not counted. This can eliminate disparity in the number of uses of the infrastructure that could be generated by special circumstances, facilitating detection of the difference between normal and abnormal conditions.

Therefore, the number of uses of a home infrastructure can be balanced, allowing more appropriate detection of an abnormal condition.

Preferably, the abnormal condition detecting system further includes a detection unit detecting use of the home infrastructure; and a first communication unit transmitting information related to the detected use of the home infrastructure to the acquisition unit.

According to the present invention, the result detected by the detection unit is transmitted to the acquisition unit by the first communication unit. This allows the detection unit (and the first communication unit) to be provided in a manner physically separated from the device (a main device; hereinafter referred to as "parent device 1") configured by the acquisition unit, the count unit, the determination unit and the recognition unit.

Therefore, the degree of freedom relative to the use of the entire system may be extended such that the detection unit (and the first communication unit) may be installed directly onto a home infrastructure such as a bathroom door and that parent device 1 is installed near an AC power-supply. Furthermore, extensibility of the system can also be increased, such that the detection unit (and the first communication unit) may be installed later.

Preferably, when there are a plurality of detection units in the abnormal condition detecting system, the first communication unit further transmits identification information for identifying each detection unit, and the recognition unit recognizes an abnormal condition of a user by further considering the transmitted identification information.

According to the present invention, when there are a plurality of detection units, each detection unit also transmits its own identification information together with the detected result. The recognition unit received the information may identify which home infrastructure the detected result belongs to. Therefore, the type or the like of each home infrastructure may be considered for mutual relations between infrastructures, enabling appropriate recognition of an abnormal condition of the user.

Preferably, the abnormal condition detecting system further includes a first power-supply unit supplying power to the first communication unit. The first power-supply unit supplies power when the first communication unit performs transmission.

According to the present invention, the first communication unit is supplied with power when it transmits the information related to the use of a home infrastructure detected by the detection unit. The power is supplied only as required, so that needless power consumption can be reduced.

Preferably, the abnormal condition detecting system further includes a first power-supply unit supplying power to the first communication unit. The first power-supply unit provides a power-supply different from the power-supply provided for the detection unit.

According to the present invention, the first communication unit is provided with a separate power-supply unit different from that of parent device 1. This eliminates the need for providing a line between parent device 1 and the detection unit for supplying power. Moreover, the separate power-supply facilitates the control for power consumption.

Preferably, the abnormal condition detecting system further includes a first capacity determination unit determining whether or not there is a shortage of capacity in the first power-supply unit; and a first sound alarming unit alarming that there is the shortage of capacity when the first capacity determination unit determines that there is the shortage of capacity. The first sound alarming unit is activated when the detection unit detects the use of the home infrastructure.

According to the present invention, when there is a shortage of capacity in the first power-supply, an alarming sound is emitted upon detection of the use of the home infrastructure to notify the user of the shortage of capacity. This allows the user to surely be informed of the shortage of capacity.

Preferably, the abnormal condition detecting system further includes a second communication unit transmitting information to the outside of a residence. The second communication unit transmits to a predetermined destination that a user is in an abnormal condition, when the recognition unit recognizes an abnormal condition of a user.

According to the present invention, when the abnormal condition of the user is recognized, the predetermined destination is notified thereof. Thus, even when the user cannot communicate to the outside, the system automatically notifies someone outside about the abnormal condition at an early stage.

Preferably, the abnormal condition detecting system further includes a third communication unit transmitting the abnormal condition of the user recognized by the recognition unit to the second communication unit. The second communication unit receives a transmitted result from the third communication unit and transmits to a predetermined destination that the user is in the abnormal condition.

According to the present invention, the result recognized by the recognition unit is transmitted to the second communication unit by the third communication unit. This allows only the second communication unit to be provided in a physically-separated manner. Therefore, the degree of freedom relative to the use of the entire system can be extended, such that the detection unit or the like may be installed directly to a home infrastructure and only the second communication unit is installed at a location connectable to a telephone line. This further facilitates later provision of units other than the second communication unit in order to detect the use of a plurality of home infrastructures and hence enables enhancement of the system extensibility.

Preferably, the abnormal condition detecting system further includes a second power-supply unit supplying power to the second communication unit. The second power-supply unit supplies power when the communication unit performs transmission.

According to the present invention, the second communication unit is supplied with power when it transmits to the outside the abnormal condition of the user recognized by the recognition unit. The power is supplied only as required, so that needless power consumption can be reduced.

Preferably, the abnormal condition detecting system further includes a second power-supply unit supplying power to the second communication unit. The second power-supply unit provides a power-supply different from the power-supply provided for the recognition unit.

According to the present invention, the second communication unit is provided with a separate power-supply unit. The separate power-supply unit facilitates the control for power consumption.

Preferably, the abnormal condition detecting system further includes a second capacity determination unit determining whether or not there is a shortage of capacity in the second power-supply unit; and a second sound alarming unit alarming that there is the shortage of capacity when the second capacity determination unit determines that there is a shortage of capacity. The second sound alarming unit is activated when the detection unit detects the use of the home infrastructure.

According to the present invention, when there is a shortage of capacity in the second power-supply unit, the alarming sound is emitted to notify the user of the shortage of capacity upon detection of the use of a home infrastructure. This allows the user to surely be informed of the shortage of capacity.

Preferably, the abnormal condition detecting system further includes a third power-supply unit supplying power to the third communication unit. The third power-supply unit supplies power when the third communication unit performs transmission.

According to the present invention, the third communication unit is supplied with power when it transmits the abnormal condition of the user recognized by the recognition unit to the second communication unit. The power is supplied only as required, so that needless power consumption can be reduced.

Preferably, the abnormal condition detecting system further includes a third power-supply unit supplying power to the third communication unit. The third power-supply unit providing a power-supply different from the power-supply provided for the recognition unit.

According to the present invention, the third communication unit is provided with a separate power-supply unit. This eliminates the need for providing a line for power-supply between the third communication unit and another unit such as the detection unit. Moreover, the separate power-supply facilitates the control for power consumption.

Preferably, the abnormal condition detecting system further includes a third capacity determination unit determining whether or not there is a shortage of capacity in the third power-supply unit; and a third sound alarming unit alarming that there is the shortage of capacity when the third capacity determination unit determines that there is a shortage of capacity. The third sound alarming unit is activated when the detection unit detects the use of the home infrastructure.

According to the present invention, when there is a shortage of capacity in the third power-supply unit, the alarming sound is emitted to warn the shortage of capacity upon detection of the use of the home infrastructure. This allows the user to surely be notified of the shortage of capacity.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention is now described with reference to the drawings.

First Embodiment

The present system 100 is integrally formed as one unit and is installed at a portion where use/non-use of a home infrastructure such as a bathroom door can be detected.

Figure 1:
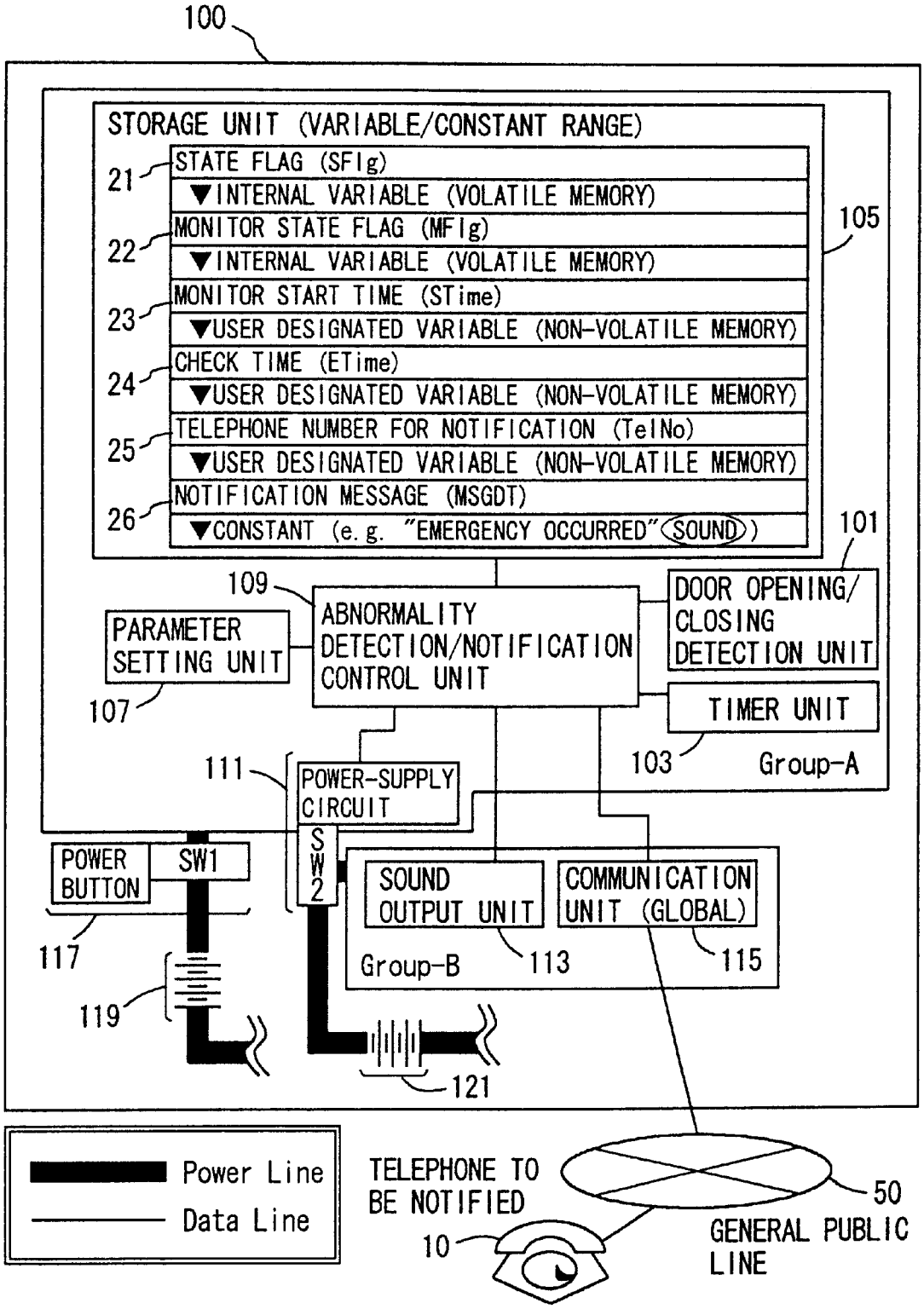
FIG. 1 is a block diagram showing the entire configuration of an abnormal condition detecting system according to the first embodiment of the present invention.

Referring to FIG. 1, an abnormal condition detecting system 100 includes a door opening/closing detection unit 101 detecting opening/closing operations of the door; a timer unit 103 clocking date and time; a storage unit 105 storing various parameters, flag states and so forth; a parameter setting unit 107 setting various parameters; a sound output unit 113 generating alarming sound or the like; a communication unit 115 transmitting information to the outside of a residence; and an abnormality detection notification control unit 109 controlling all the units described above.

Door opening/closing detection unit 101 detects, for example, opening/closing of a bathroom door to detect use frequency of a home infrastructure. It is not necessary here to distinguish the opening and closing operations, so that e.g. a body temperature sensor is used. The detection may be performed by controlling a mechanism in view of low power consumption.

Timer unit 103 clocks date and time, and is referred at the time of controlling by abnormality detection notification control unit 109. Storage unit 105 stores flags such as a state flag (SFlg) 21, a monitor state flag (MFlg) 22; values for parameters such as monitor start time (STime) 23, check time (ETime) 24, a telephone number for notification (TelNo) 25; and a constant of a notification message (MSGDT) 26 or the like.

State flag (SFlg) 21 and monitor state flag (MFlg) 22 may be stored into a volatile memory such as a RAM, whereas monitor start time (STime) 23, check time (ETime) 24, telephone number for notification (TelNo) 25, and notification message (MSGDT) 26 are stored into a non-volatile memory. This is to eliminate the need for re-setting a memory every time a power-supply is turned on.

The user enters monitor start time (STime) 23, check time (ETime) 24 and telephone number for notification (TelNo) 25 from parameter setting unit 107. The entered parameter values are stored into storage unit 105. It is noted that parameter setting unit 107 is configured by a numeric keypad for entering e.g. time data and telephone number data, a reset key, an enter key and so forth.

When notification message (MSGDT) 26 is a variable rather than a constant, the user enters a message from parameter setting unit 107. Thus, in such a case, parameter setting unit 107 is configured to include keys by which the user can enter characters, a sound input unit or the like.

Sound output unit 113 emits an appropriate alarming sound when, for example, abnormality is detected by abnormality detection notification control unit 109. Communication unit 115 is connected to a general public line 50, and communicates to the outside when an abnormality is detected by abnormality detection notification control unit 109. Thus, when an abnormality is detected, communication unit 115 is connected via general public line 50 to a telephone to be notified 10 (hereinafter simply referred to as "telephone 10") that has been set by the user. The notification message stored in storage unit 105 is then transmitted to notify the others that the inhabitant is in an abnormal condition.

It is noted that the present system 100 is installed at a door or the like, so that a wireless type is used for general public line 50.

These sound output unit 113 and communication unit 115 (hereinafter referred to as "Group-B" ) are supplied with power from a battery 121. On/off of the power-supply is controlled by a power-supply circuit 111 controlling SW2. Power-supply circuit 111 is connected to abnormality detection notification control unit 109 to receive an abnormality detection signal from abnormality detection control unit 109, and turns on SW2 to supply power when a sound output or a notification to the outside is required.

On the other hand, door opening/closing detection unit 101, timer unit 103, storage unit 105, parameter setting unit 107, and abnormality detection notification control unit 109 (hereinafter referred to as "Group-A") are supplied with power by a battery 119. On/off of the power-supply is controlled by the user operating a power button 117. This turns on/off SW1 to turn on/off the power-supply from battery 119.

Figure 2:
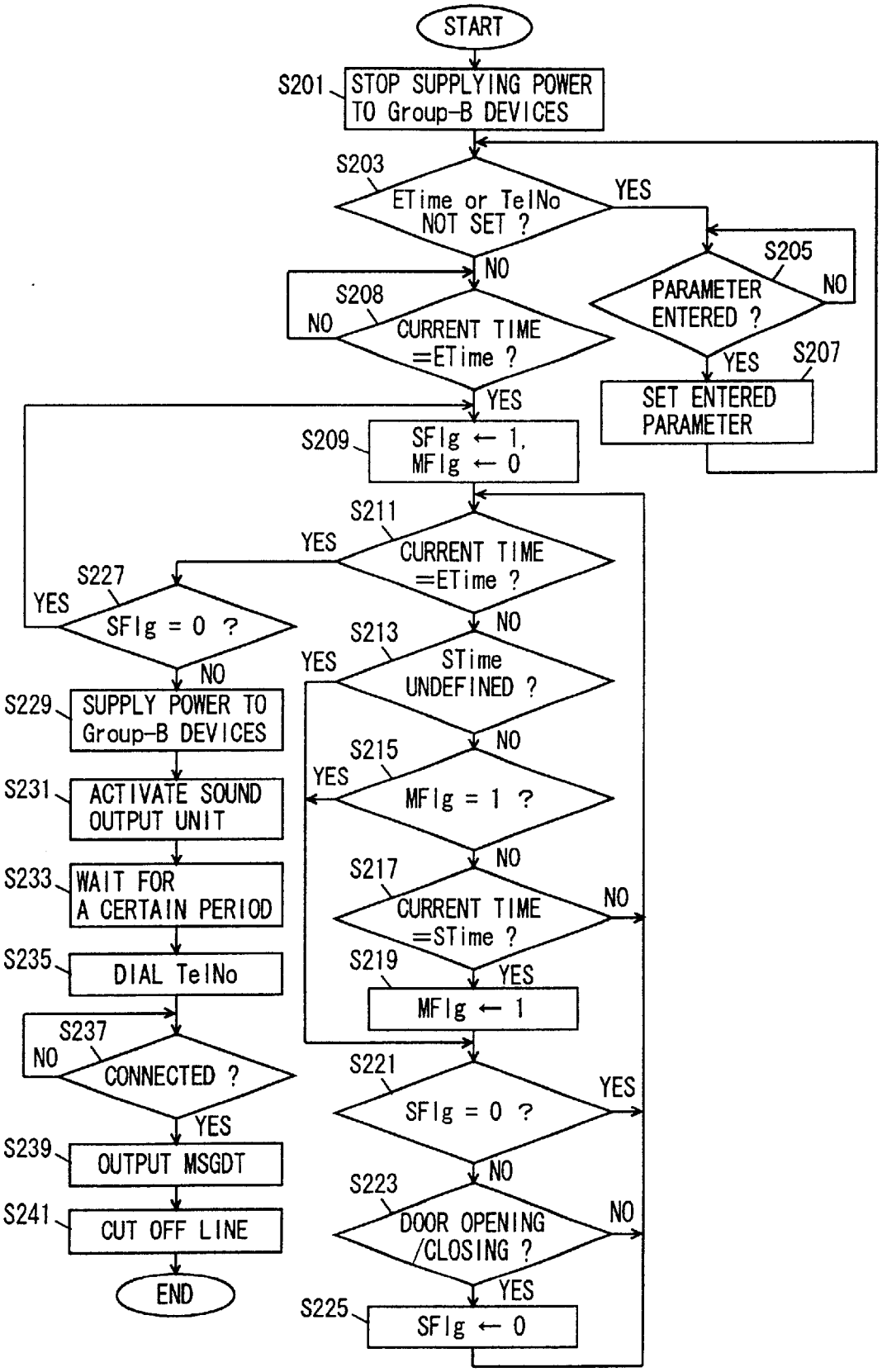
FIG. 2 is a flow chart showing the entire process flow of the abnormal condition detecting system.

Subsequently, the process flow of abnormal condition detecting system 100 shown in FIG. 1 is described. FIG. 2 is a flow chart showing the flow of the entire process in abnormal condition detecting system 100.

Referring to FIG. 2, when the user (inhabitant) turns on power button 117, power is supplied to the devices of Group-A, and abnormality detection notification control unit 109 is activated. Thereafter, first, in step S201, a power-supply cutting signal is sent from abnormality detection notification control unit 109 to power-supply circuit 111 to stop the power supplied to the devices of Group-B.

Subsequently, in step S203, parameters ETime (check time) and TelNo (telephone number for notification) are checked if a value is set to each of the parameters. If even one of the above is not set ("YES" in step S203), the user is urged in step S205 to enter parameter values. When the parameter values are entered, in step S207, each of the entered values are stored into a storage region for each parameter in storage unit 105.

In step S205, the user is also urged to enter a value for the parameter STime (monitor start time) in addition to ETime and TelNo. Setting of ETime and TelNo is essential whereas setting of STime is optional with the user. If STime is entered by the user, opening/closing of the door is detected during a period from STime to ETime, whereas if no STime is entered, opening/dosing of the door is detected during a period from ETime to ETime, i.e. all the time. The period for which the opening/closing of the door is detected (from STime to ETime or from ETime to ETime) is hereinafter referred to as "detection period."

If it is determined, in step S203, that ETime and TelNo are set ("NO" in step S203), it is then determined in step S208 whether or not the current time corresponds with the set ETime (check time). Then, as the current time reaches ETime, the process moves on to step S209.

The process must wait until the current time reaches ETime for the purpose of making accurate determination of the abnormality detection (step S227). That is, if ETime is reached, for example, one second after the power is turned on, the abnormality detection will be determined based on the detection result obtained in such a short detection period. In such a case, no opening/closing of the door is detected, and thus it is incorrectly determined that an abnormal condition has occurred. To avoid this, in step S208, the process waits until the first ETime after the power is turned on, so that a sufficient detection period is secured.

When the current time reaches ETime, a flag is initialized in step S209. That is, 1 is set to SFlg (state flag) and 0 is set to MFlg (monitor state flag).

Here, SFlg is a flag indicating a detection state of door opening/closing, where 1 means a state where no opening/dosing of the door is detected, whereas 0 means opening/dosing of the door is detected. Moreover, MFlg is a flag indicating whether or not the current time is within the detection period, i.e. a monitor state, where 0 means that the current time is out of the detection period, whereas 1 means that it is within the detection period.

Subsequently, in step S211, timer unit 103 is referred to determine whether or not the current time corresponds to the set ETime. This is where whether or not the time has come for checking the detection result of door opening/closing is determined.

If the current time does not correspond with ETime, it is determined in the processes from step S213 to step S217 whether or not the current time is within the detection period. First, in step S213, it is determined whether or not STime is set. If STime is not set ("YES" in step S213), meaning that the current time is necessarily within the detection period, the process moves on to step S221 for performing the process of detecting door opening/dosing.

If STime is set ("NO" in step S213), it is determined in step S215 whether or not MFlg is 1, i.e., whether or not the current time has already entered into the detection period.

If MFlg is 1 meaning that the current time has already entered into the detection period ("YES" in step S215), the process is moved on to step S221 for performing the process of detecting opening/dosing of the door. On the other hand, if MFlg is 0 meaning that the current time has not yet entered into the detection period ("NO" in step S215), the process moves on to step S217.

Thereafter, in step S217, it is determined whether or not the current time corresponds with STime. If it is determined that the current time corresponds with STime, MFlg is set to be 1 in step S219 for indicating that the current time has entered into the detection period, and then the process moves on to step S221.

On the other hand, if it is determined that the current time does not correspond with STime ("NO" in step S217), meaning that current time has not yet entered into the detection period, the process goes back to step S211. Then, the processes described above (from step S211 to step S217) are repeated until the current time enters into the detection period.

If the current time enters into the detection period, it is determined in step in S221 whether or not SFlg is 0, i.e., whether or not the door opening/closing has already been detected. If SFlg is 0, meaning that the door opening/closing has already been detected, the process goes back to step S211.

If SFlg remains at 1, meaning that the door opening/closing has not yet been detected, the process moves on to step S223. Then, in step S223, it is determined whether or not the door opening/closing is detected by door opening/closing detection unit 101. If the door opening/closing has not been detected, the process immediately goes back to step S211. On the other hand, if it is determined that the door opening/dosing has been detected, SFlg is first set to be 0 in step S225, and thereafter the process goes back to step S211.

If it is determined in step S211 that the current time corresponds with ETime, i.e., if the time has come for checking the result of the door opening/dosing state, the process moves on to step S227. In step 227, it is determined whether or not SFlg is 0 to check whether or not the door was opened or closed at least once during the detection period.

If SFlg is 0 ("YES" in step S227), meaning that at least one opening/closing of the door was detected during the detection period, no abnormal condition of the inhabitant is detected, and the process goes back again to step S209. Then the detection processes described above from step S209 downward are repeated.

On the other hand, if it is determined that SFlg is not 0 in step S227 ("NO" in step S227), it means that the opening/closing of the door was not detected even once during the detection period. Therefore, a notification process for the abnormality detection is performed in processes of steps S229 downward.

First, in step S229, power-supply circuit 111 is controlled to supply power to the devices of Group-B. The devices of Group-B is thus supplied with power only as required, allowing reduction of needless power consumption.

Subsequently, in step S231, sound output unit 113 is activated to output an alarming sound. Then, after a wait for a certain period (step S233), a preset TelNo (a telephone number for notification) is automatically dialed in step S235.

Thus, the process of step S235 (auto-dialing) is not immediately performed after Group-B is supplied with power. The alarming by sound output unit 113 and the waiting process are performed before the auto-dialing process in order to prevent the notification to the outside in response to an incorrect detection. Even if the abnormal condition of the inhabitant was incorrectly detected for some reason, the user (inhabitant) would notice the incorrect detection by the alarming sound and could operate power button 117 to turn off the power-supply. Therefore, such notification of abnormality to the outside as a result of an incorrect detection can be prevented.

In step S235, when TelNo is automatically dialed and telephone 10 is connected (step S237), a pre-registered MSGDT (notification message) is transmitted from communication unit 115 to telephone 10 in step S239. Telephone 10 side receives the message to find that the inhabitant is in an abnormal condition. When the output of the message is terminated, the telephone line is cut off (step S241).

Through the processes described above, whether or not the inhabitant is in an abnormal condition can appropriately be determined by periodically detecting the use frequency of a home infrastructure, such as the opening/closing state of a bathroom door, for a certain period. If it is determined that there is an abnormal condition, a pre-registered acquaintance or the like is notified thereof. Therefore, an emergency, such that an aged person living alone falls down, can be found at an early stage, enabling more appropriate action to be taken.

Moreover, the processes described above can be realized in a simple configuration as shown in FIG. 1, enabling provision of an apparatus that can easily be utilized at a low cost even by a person living alone who has currently no problem in health.

It is noted that, in the present embodiment, if the door opening/closing is detected at least once, 0 is set to SFlg, as indicated in steps S223 and S225 in FIG. 2. If 0 is set to SFlg, it is determined that the inhabitant is not in an abnormal condition (step S227). Thus, in the present embodiment, the predetermined value is set at 0, and only when a counted value is 0 or lower, it is determined that the inhabitant is in an abnormal condition. However, the predetermined value is not limited to such a case, and maybe set to be a number higher than 0. Moreover, a plurality of predetermined values may be provided such that the level of emergency can be recognized in accordance with the number of detections counted during a detection period, based on the predetermined values.

Furthermore, an abnormal condition of the inhabitant may be detected by comparing the number of counted detection times and the number of average detection times. The number of average detection times is obtained based on the number of detection times counted during a detection period. Then, if the number of counted detection times is continuously extremely lower compared to the number of average detection times, it may be determined that the inhabitant is in an abnormal condition.

Second Embodiment

Figure 3:
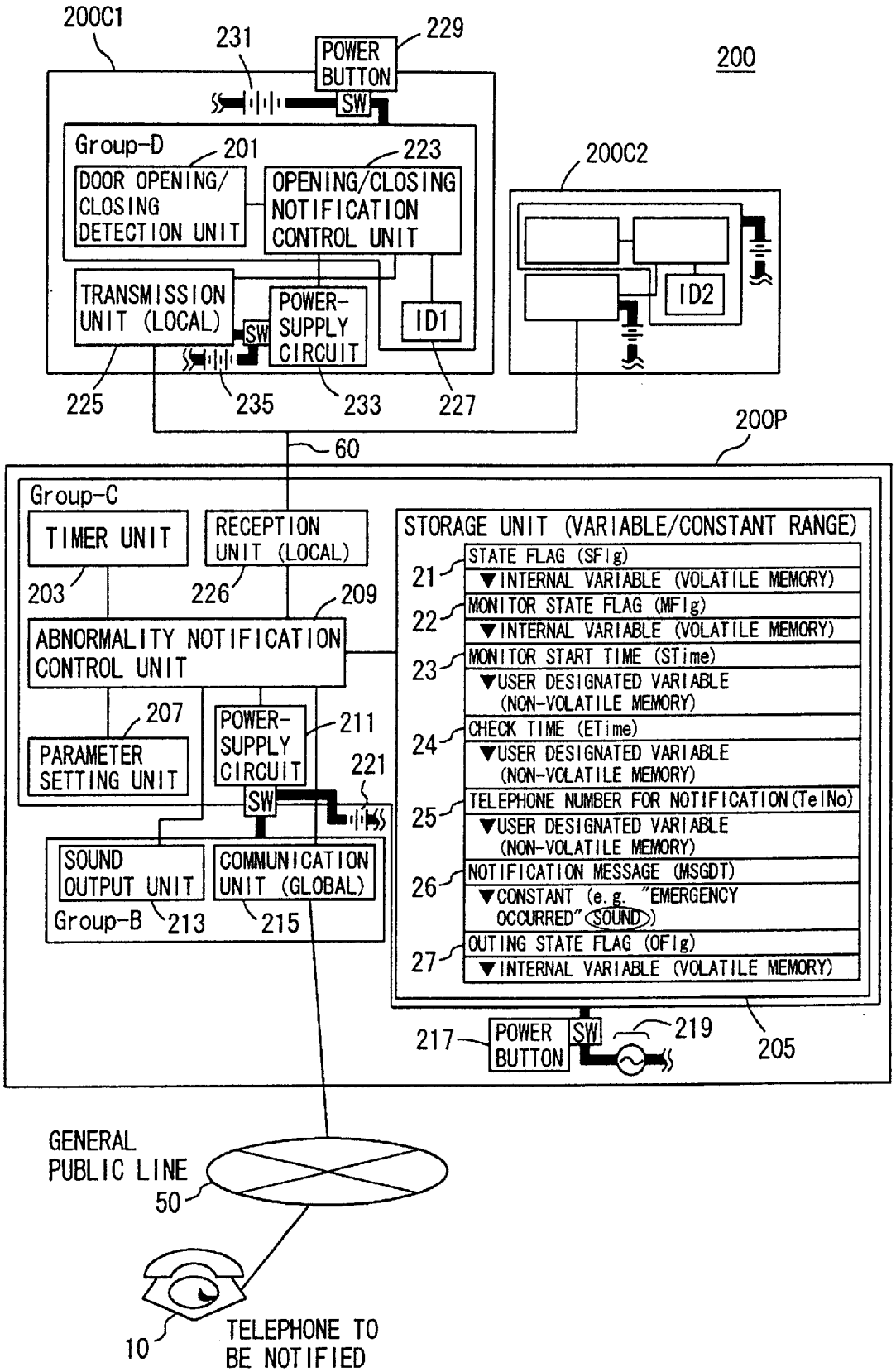
FIG. 3 is a block diagram showing the entire configuration of an abnormal condition detecting system according to the second embodiment of the present invention.

An abnormal condition detecting system 200 according to the second embodiment of the present invention is now described. FIG. 3 is a block diagram showing the entire configuration of an abnormal condition detecting system 200 according to the second embodiment of the present invention. Referring to FIG. 3, abnormal condition detecting system 200 is configured by a parent device 200P and child (sub) devices 200C1, 200C2. Parent device 200P and child devices 200C1, 200C2 are respectively connected by a communication line 60. Although it is more advantageous to use a wireless line for communication line 60 in view of distribution works, a wired line may also be used.

Child devices 200C1 and 200C2 have a similar configuration except for the respective reference numbers for identification. Therefore, child device 200C1 will be described here. It is noted that child device 200C1 is installed at a bathroom door and child device 200C2 is installed at an entrance door.

Child device 200C1 includes a door opening/closing detection unit 201 detecting opening/closing operation of the door, a transmission unit (local) 225 transmitting the result of opening/closing detection to parent device 200P, a storage unit 227 storing the device's own identification number ID1, and an opening/closing notification control unit 223 performing e.g. control of all the units described above.

Storage unit 227 stores an identification number "ID1" indicating that it is a child device installed to a home infrastructure used in the present system. When opening/closing is detected by door opening/closing detection unit 201, transmission unit 225 transmits the fact to parent device 200P. At that time, the device's own identification number ID1 is simultaneously transmitted therewith.

It is noted that transmission unit (local) 225 receives the power-supply from a battery 235. On/off of the power-supply is controlled by a power-supply circuit 233 controlling SW. Power-supply circuit 233 is connected to opening/closing notification control unit 223 to receive an opening/closing detection signal from door opening/closing detection unit 201, and turns on SW to supply power when the transmission to parent device 200P is required.

Whereas, door opening/closing detection unit 201, opening/closing notification control unit 223 and storage unit 227 (hereinafter referred to as "Group-D") are supplied with power by a battery 231. On/off of the power-supply is controlled by a user operating a power button 229. This turns on/off SW to turn on/off the power-supply from battery 231.

Parent device 200P includes a reception unit (local) 226 receiving the detection result from child devices 200C1 and 200C2; a timer unit 203 clocking date and time; a storage unit 205 storing various parameters, flag states or the like; a parameter setting unit 207 setting various parameters; a sound output unit 213 generating an alarming sound or the like; a communication unit (global) 215 transmitting information to the outside; and an abnormality notification control unit 209 controlling all the units described above.

Reception unit 226 receives the door opening/closing detection information and the identification information transmitted from the respective transmission units of child devices 200C1 and 200C2. Abnormality notification control unit 209 receives the received result and determines whether or not it is an abnormal condition, to control communication unit 215 and so forth.

Storage unit 205 stores, as in the case with storage unit 105 in FIG. 1, a state flag (SFlg) 21, a monitor state flag (MFlg) 22, a monitor start time (STime) 23, a check time (ETime) 24, a telephone number for notification (TelNo) 25, and a notification message (MSGDT) 26. Moreover, an outing state flag (OFlg) 27 is also stored. It is noted that outing state flag (OFlg) 27 is stored into a volatile memory.

Sound output unit 213 and communication unit 215 are similar to sound output unit 113 and communication unit 115 shown in FIG. 1 according to the first embodiment. Thus, an alarming sound is emitted from sound output unit 213 when there is an abnormal condition, and communication unit 215 notifies a telephone 10 of the abnormal condition via a general public line 50.

Unlike abnormal condition detecting system 100 in FIG. 1, there is no need to install parent device 200P onto a door, so that a wired type for which the connection fee is low is used as general public line 50. A wireless type may, however, also be used.

These sound output unit 213 and communication unit 215 (Group-B) are supplied with power by a battery 221, and on/off of the power-supply is controlled by power-supply circuit 211 controlling SW.

On the other hand, timer unit 203, storage unit 205, parameter setting unit 207, abnormality notification control unit 209, and reception unit (local) 226 (hereinafter referred to as "Group-C") are supplied with power from an AC power-supply 219. On/off of the power-supply is controlled by the user operating power button 217.

Thus, by employing such a configuration having parent device 200P and a plurality of child devices 200C1 and 200C2 rather than configuring the entire system as one unit, usability of the system is improved for the user. This allows only the child devices to be installed directly onto a home infrastructure and the parent device to be installed near the AC power-supply or near the telephone line.

Moreover, the use of the plurality of child devices allows detection of the use frequency of a plurality of home infrastructures. Thus, accuracy and quality of the abnormality detection are improved, while incorrect detection is reduced.

Furthermore, each child device allows detection of the use frequency corresponding to each of the home infrastructures, enabling determination of an abnormal condition not only in the case where an inhabitant falls down but also in various unusual cases where, for example, the inhabitant is seriously ill in bed. Therefore, an abnormal condition of the inhabitant can be more accurately and more specifically detected.

Although an example where two child devices are employed is shown here, a configuration in which a larger number of child devices are employed may be possible.

Subsequently, the process flow of abnormal condition detecting system 200 shown in FIG. 3 will be described with reference to FIGS. 4 to 7.

Figure 4:
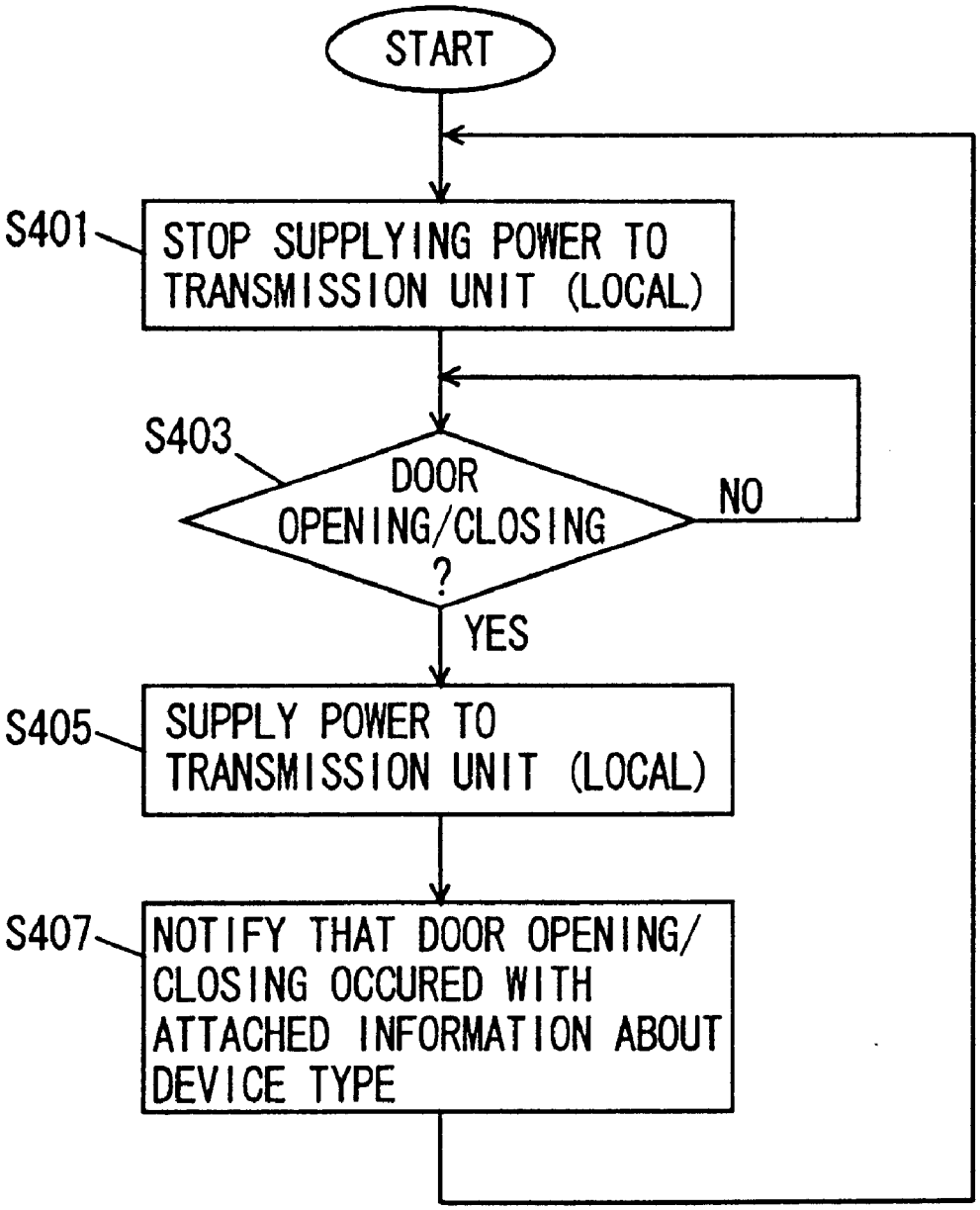
FIG. 4 is a flow chart showing the process flow of an opening/dosing notification control unit on a child device side.

FIG. 4 is a flow chart showing the process flow of opening/closing notification control unit 223 on a child device side. Referring to FIG. 4, first, when power button 229 is pressed by the user, power is supplied to the devices of Group-D from battery 231 to actuate opening/closing notification control unit 223.

Opening/closing notification control unit 223 stops the power supplied to transmission unit (local) 225 in step S401. Subsequently, in step S403, it is determined whether or not opening/closing of a door was detected by door opening/dosing detection unit 201. Then, the process of detecting opening/dosing is repeated until the opening/closing of the door is detected.

When the opening/closing of the door is detected, power is supplied to transmission unit (local) 225 in step S405. Thereafter, in step S407, transmission unit 225 transmits to reception unit (local) 226 that the door opening/dosing was detected, along with the identification information (ID1) of a child device. When the transmission is terminated, the process goes back to step S401, and the power-supply to transmission unit (local) 226 is again stopped. Then, the process continues to detect opening/dosing of the door (step S403).

Figure 5:
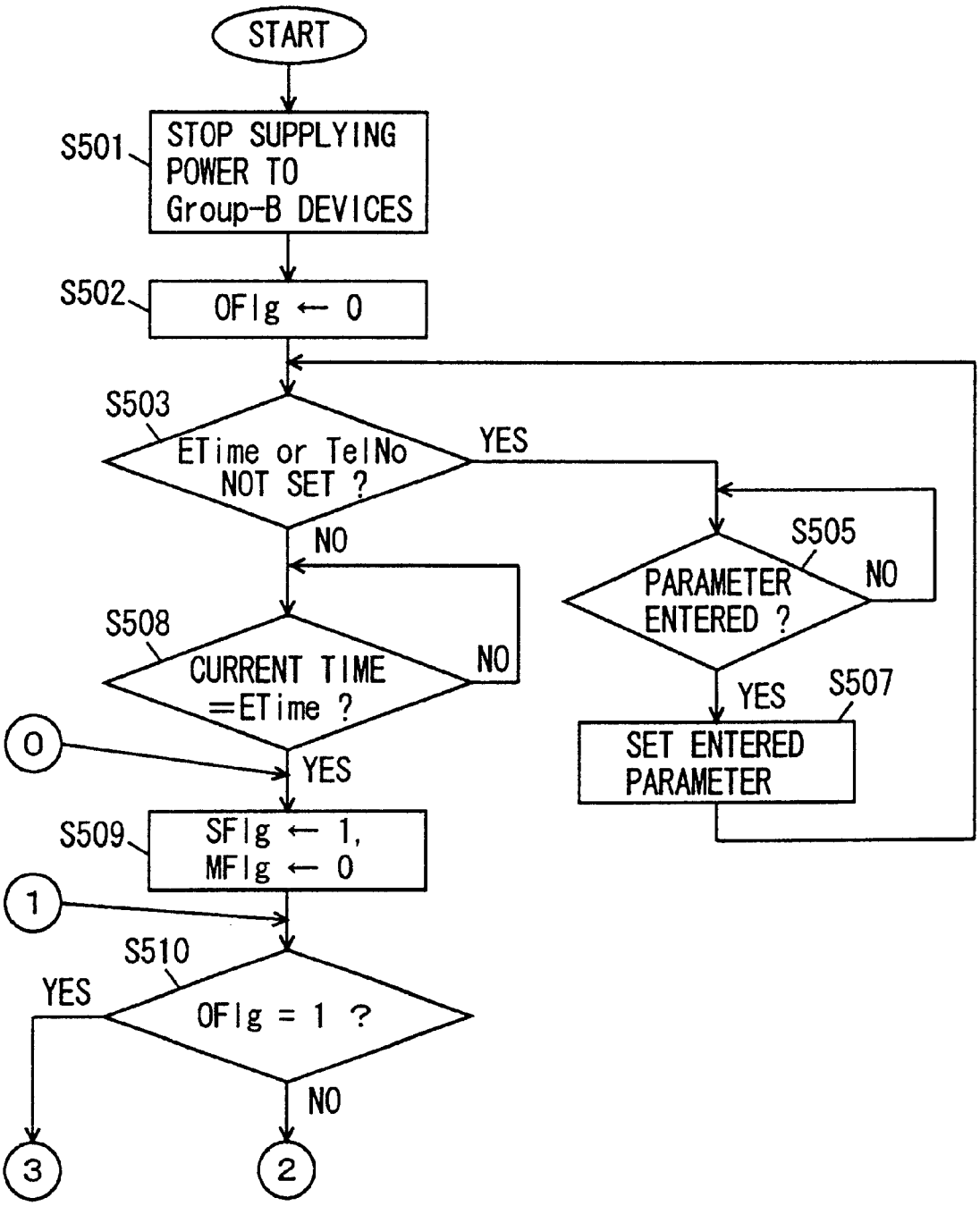
FIG. 5 is a flow chart showing the process flow of an abnormality notification control unit on a parent device P side.
Figure 6:
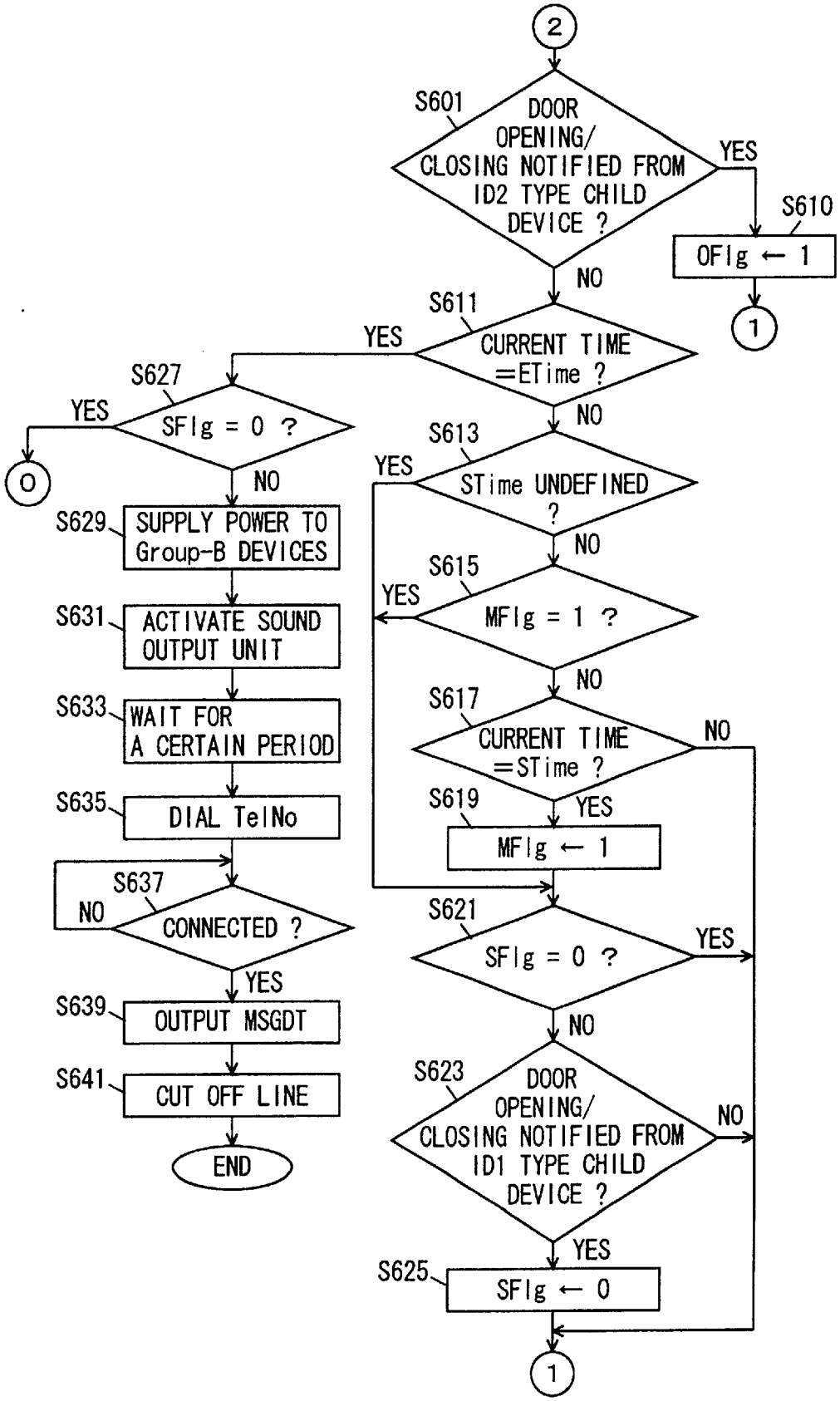
FIG. 6 is a flow chart showing the process flow of the abnormality notification control unit on the parent device P side when an inhabitant is at home.
Figure 7:
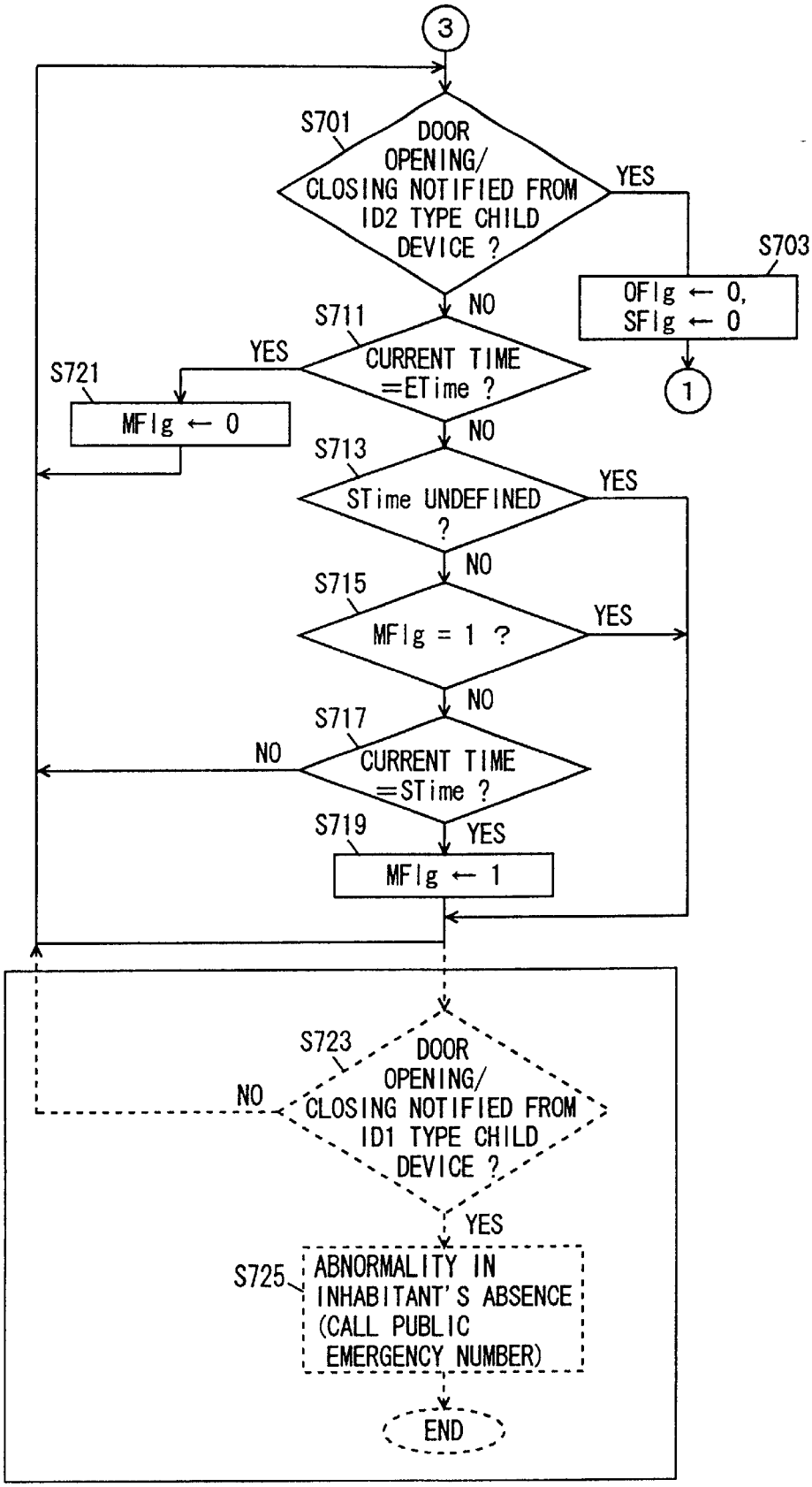
FIG. 7 is a flow chart showing the process flow of the abnormality notification control unit on the parent device P side when the inhabitant is out.

FIGS. 5, 6 and 7 are flow charts showing the process flow of abnormality notification control unit 209 on parent device 200P side. First, referring to FIG. 5, when the user presses power button 217, current is supplied from AC power-supply 219 to the devices of Group-C to actuate abnormality notification control unit 209.

Abnormality notification control unit 209 stops the power supplied to the devices of Group-B in step S501. Subsequently, in step S502, OFlg (outing state flag) is initialized. That is, 0 is set to OFlg stored in storage unit 205.

OFlg is a flag indicating if an inhabitant is currently in or out, in which 0 means that the inhabitant is at home, whereas 1 means that the inhabitant is out.

Subsequently, in step S503, it is determined whether or not ETime (check time) and TelNo (the telephone number for notification) are set. If they are not yet set, the user is urged to enter the parameters for ETime, TelNo and STime in step S505, and the entered parameters are stored into respective predetermined regions of storage unit 205 in step S507. On the other hand, if ETime and TelNo are set, the process waits until the current time reaches ETime in step S508, and when ETime is reached, 1 is set to SFlg (state flag) and 0 is set to MFlg (monitor state flag) in step S509.

These processes from the steps S503 to S509 are similar to the processes from steps S203 to S209 in the flow chart shown in FIG. 2.

When the initialization for SFlg and MFlg are completed, it is determined in step S510 whether or not OFlg is 1. That is, it is determined whether or not the inhabitant is in or out. If OFlg is 0 meaning that the inhabitant is at home ("NO" in step S510), the process moves on to step S601 shown in FIG. 6. If OFlg is 1 meaning that the inhabitant is out ("YES" in step S510), the process moves on to step S701 shown in FIG. 7.

Subsequently, the process shown in FIG. 6 in which the inhabitant is at home is described. Referring to FIG. 6, when the inhabitant is at home, first, in step S601, it is determined whether or not a door opening/closing detection notification is received from child device 200C2. If the door opening/closing notification is detected, OFlg is changed to 1 (out) in step S601. Child device 200C2 is installed onto an entrance door, so that it is assumed from the door opening/closing detection notification from child device 200C2 that the inhabitant has gone out. Then, the process goes back to step S510 in FIG. 5.

In step S601, if no door opening/closing detection notification is received from child device 200C2, the process moves on to the processes from step S611 downward. It is noted that the processes from steps S611 to S641 are similar to the processes from steps S211 to S241 shown in the flow chart in FIG. 2.

However, only the process in step S623 is different from step S223 in FIG. 2, in which it is determined whether or not the door opening/closing detection notification from child device 200C1 is received.

As for the process flow, if "NO" is selected in step S617, if "YES" is selected in step S621, if "NO" is selected in step S623, or if the process in step S625 is terminated, the process moves back to step S510 in FIG. 5. Furthermore, if "YES" is selected in step S627, the process goes back to step S509 in FIG. 5.

Subsequently, the process shown in FIG. 7 in which the inhabitant is out will be described. Referring to FIG. 7, when the inhabitant is out, first, it is determined in step S701 whether or not the door opening/closing detection notification is received from child device 200C2. If the door opening/closing notification is detected, OFlg is changed to 0 (at home) in step S703. Moreover, SFlg is changed to 0 (the state where a home infrastructure is operated). Thereafter, the process goes back to step S510 in FIG. 5.

In step S701, if no door opening/dosing detection notification is received from child device 200C2, the process moves on to step S711. It is noted that the processes from steps S711 to S719 are similar to the processes from steps S211 to S219 shown in the flow chart in FIG. 2. Moreover, in step S711, when the current time reaches ETime (check time), MFlg (monitor state flag) is reset to be 0 in step S721.

These processes from steps S711 to S721 are merely to set the states of flags (SFlg and MFlg) correctly in accordance with time, even when the inhabitant is out, and do not involve any output such as sound alarming by sound output unit 213, transmission to the outside by transmission unit 215, and so forth.

However, the door opening/closing detection notification may be produced by some abnormal circumstances when the inhabitant is out. For such a case, the processes of steps S723 and S725 may be added after the process of step S719.

In step S723, whether or not the door opening/dosing detection notification is received from child device 200C1 is checked. If no notification was received, the process goes back to step S701 as usual, whereas if a notification was received, a predetermined process for an emergency in the inhabitant's absence is performed in step S725, such as calling the number 110 (the public emergency number in Japan).

According to the processes described above, the system is appropriately activated in accordance with whether the inhabitant is in or out. Therefore, even if there is no detection of door opening/closing when the inhabitant is out, the system will not incorrectly determine that an abnormal condition occurred and will not incorrectly notify the outside of the abnormal condition. This enables more accurate determination of an abnormal condition of the inhabitant.

It is noted that the detection of opening/dosing of the entrance door is herein performed by installing child device 200C2 onto the entrance door. Specifically, if the door opening/dosing detection unit of child device 200C2 detects an odd number of opening/closings of the door, it is determined that the inhabitant is out, whereas if the unit detects an even number of opening/closings, it is determined that the inhabitant is at home. However, in order to more accurately control the in/out state of the inhabitant, for example, a door knob at each side of the door (entrance and exit sides) may be provided with a sensor. Moreover, the state of a key hole and its operation state may be detected, i.e., from a lock state to an unlock state or from an unlock state to a lock state may be detected, to detect the state transition from out to in or from in to out.

Furthermore, in the present embodiment, information for identifying child devices are stored in each of the child devices and the identification information is transmitted to the parent device together with the door opening/dosing detection information. However, if communication line 60 is a wired line, other configurations may be possible. For example, a port connected to communication line 60 is used to identify which child device has sent the door opening/closing detection information.

In the present system 200, a lock-releasing unit may be provided in child device 200C2 installed onto the entrance door. This releases the locking of the entrance door when an abnormality is detected and hence facilitates entrance of an outside helper into home.

Third Embodiment

Figure 8:
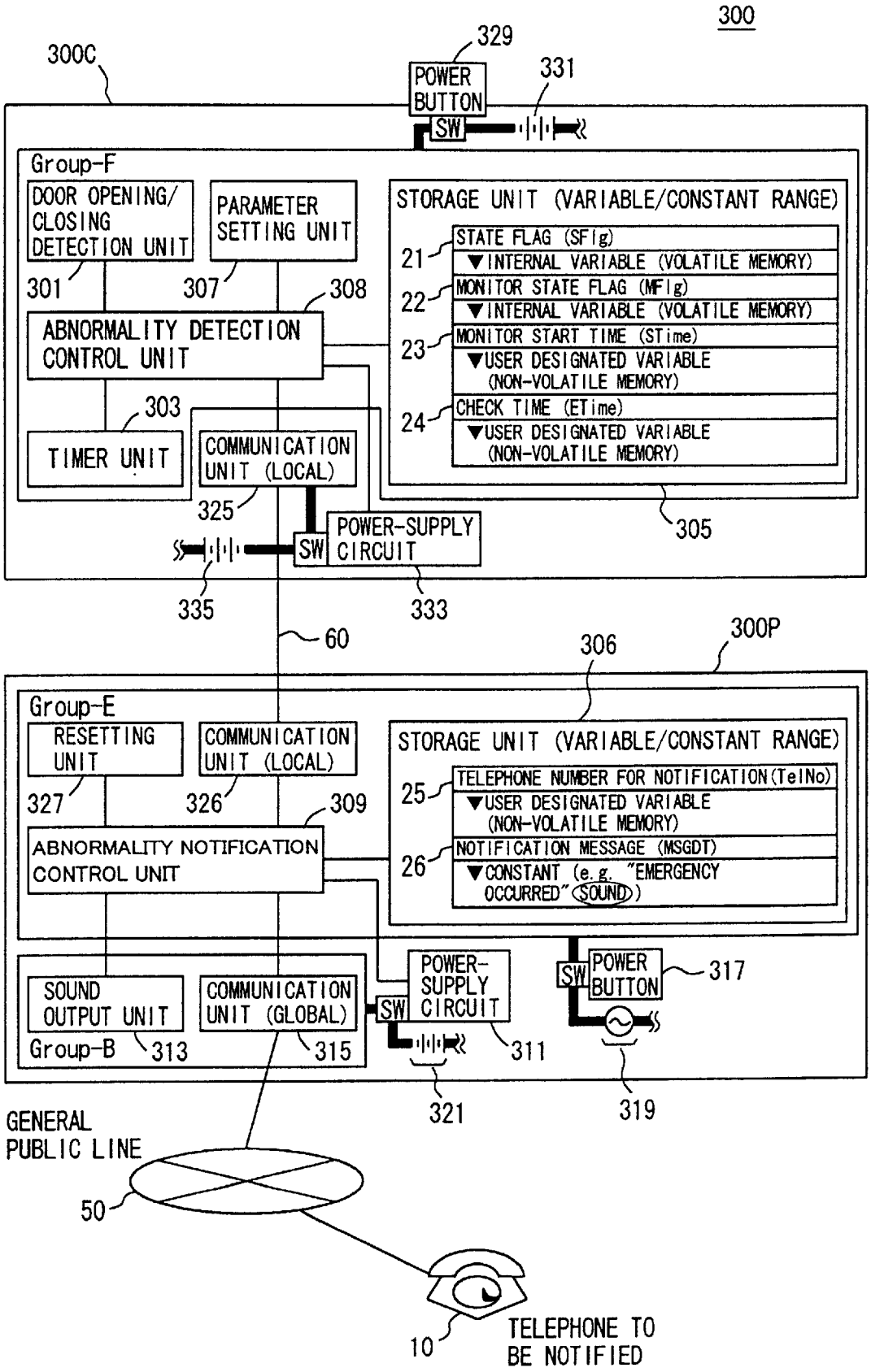
FIG. 8 is a block diagram showing the entire configuration of an abnormal condition detecting system according to the third embodiment of the present invention.

Next, an abnormal condition detecting system 300 according to the third embodiment of the present invention is described. FIG. 8 is a block diagram showing the entire configuration of abnormal condition detecting system 300 according to the third embodiment of the present invention. Referring to FIG. 8, abnormal condition detecting system 300 is configured by a parent device 300P and a child device 300C. Parent device 300P and child device 300C are connected via a communication line 60. It is noted that the communication line may be a wired line or a wireless line.

Child device 300C includes a door opening/dosing detection unit 301 detecting opening/dosing operation of the door; a timer unit 303 clocking date and time; a storage unit 305 storing various parameters, flag states or the like; a parameter setting unit 307 setting various parameters; a communication unit (local) 325 transmitting the detection result of opening/dosing to parent device 300P; and an abnormality detection control unit 308 controlling all the units described above.

Storage unit 305 stores, among parameters or the like stored in storage unit 105 in FIG. 1, state flag (SFlg) 21, monitor state flag (MFlg) 22, monitor start time (STime) 23, and check time (ETime) 24.

Here, communication unit (local) 325 is supplied with power by a battery 335. On/off of the power-supply is controlled by a power-supply circuit 333 controlling SW. Power-supply circuit 333 is connected to abnormality detection control unit 308, and turns on SW to supply power when an abnormality is detected by an opening/closing detection signal from door opening/closing detection unit 301 and is required to be transmitted to parent device 300P.

Door opening/closing detection unit 301, timer unit 303, storage unit 305, parameter setting unit 307 and abnormality detection control unit 308 (hereinafter referred to as "Group-F") are supplied with power by battery 331. On/off control of the power-supply is performed by the user operating power button 329. This turns on/off SW to turn on/off the power-supply from battery 331.

Parent device 300P includes a communication unit (local) 326 receiving the result of abnormality detection from child device 300C, a storage unit 306 storing various parameters or the like, a resetting unit 327 issuing a reset signal, a sound output unit 313 generating an alarming sound or the like, a communication unit (global) 315 transmitting information to the outside, and an abnormality notification control unit 309 controlling all the units described above.

Communication unit (local) 326 receives detection information of an abnormal condition transmitted from communication unit (local) 325 of child device 300C. Abnormality notification control unit 309 further receives the received result, appropriately controls communication unit (global) 315 or the like, and notifies the outside.

Storage unit 306 stores the telephone number for notification (TelNo) 25 and a notification message (MSGDI) 26. These variables are required in notifying of an abnormality via connection to telephone 10.

It is noted that sound output unit 313 and communication unit 315 are similar to sound output unit 113 and communication unit 115 shown in FIG. 1 according to the first embodiment. Therefore, in an abnormal condition, an alarming sound is emitted from sound output unit 313, and communication unit 315 notifies telephone 10 of the abnormality via general public line 50.

These sound output unit 313 and communication unit 315 (Group-B) are supplied with power by a battery 321, and on/off of the power-supply is controlled by a power-supply circuit 311 controlling SW.

On the other hand, storage unit 306, abnormality notification control unit 309, communication unit (local) 326, and resetting unit 327 (hereinafter referred to as "Group-E") are supplied with power from AC power-supply 319. On/off of the power-supply is controlled by the user operating a power button 317.

Although one child device 300C is described here, a plurality of child devices may also be used. Child device 300C not only detects opening/closing of the door, but also determines whether or not an abnormal condition has occurred based on the information of the detection. Therefore, the user can readily extend the system by installing a corresponding child device to a desired home infrastructure.

Furthermore, as in the case with the configuration shown in FIG. 3, a part of the parent device is supplied with power from AC power-supply. This can reduce the number of portions to which the power is supplied from a battery, reducing power consumption of the battery.

Subsequently, the process flow of abnormal condition system 300 shown in FIG. 8 will be described with reference to FIGS. 9 and 10.

Figure 9:
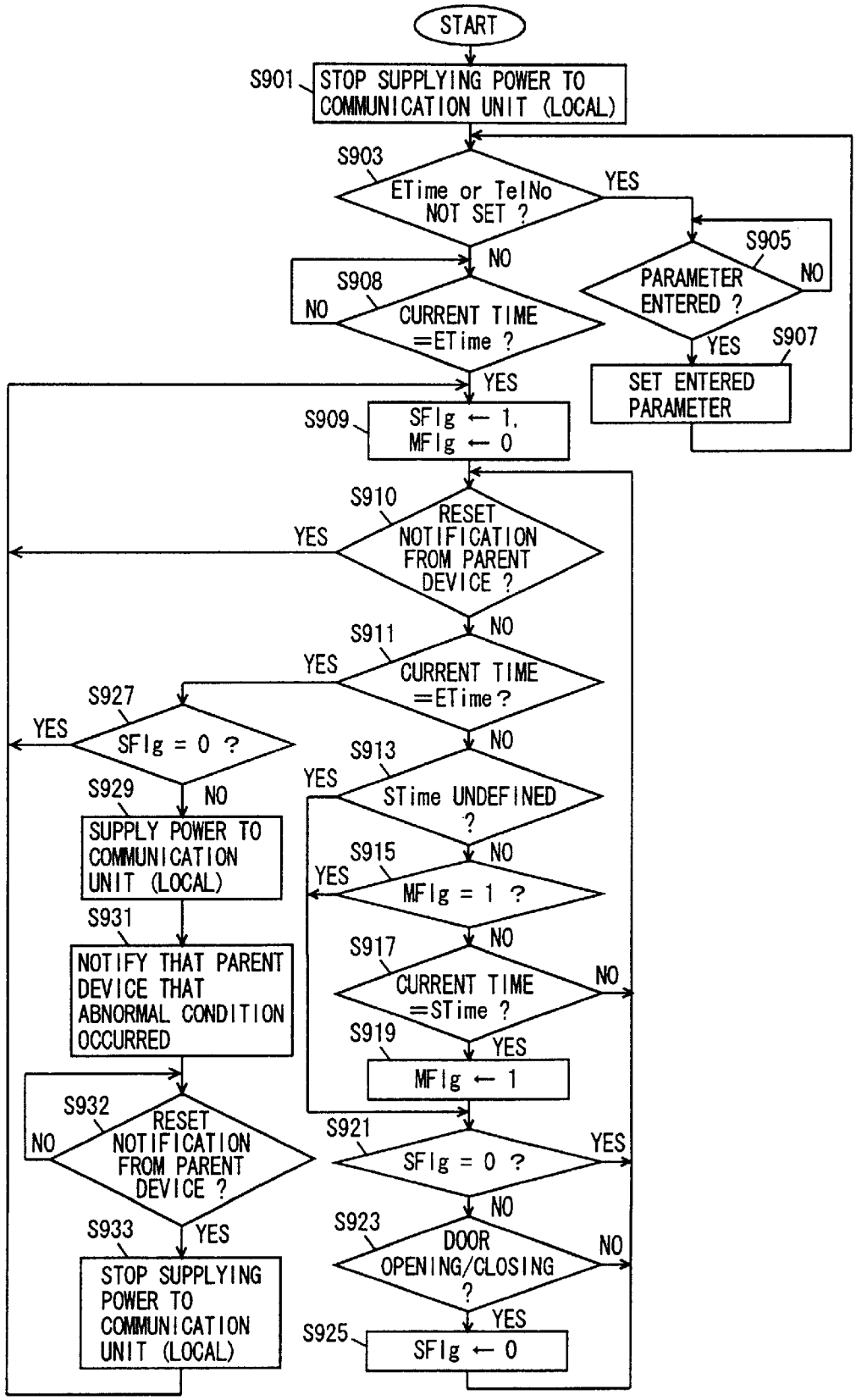
FIG. 9 is a flow chart showing the process flow of an abnormality detection control unit on a child device side.

FIG. 9 is a flow chart showing a process flow of abnormality detection control unit 308 on the child device side. Referring to FIG. 9, first, when a power button 329 is pressed by the user, power is supplied to the devices of Group-F from battery 331, to start activating abnormality detection control unit 308.

Abnormality detection control unit 308 stops the power supplied to communication unit (local) 325 in step S901. Next, the process goes on to the processes from step S903 downward, i.e. the process of detecting door opening/closing and the process of detecting an abnormal condition. It is noted that the processes from steps S903 to S927 are similar to the processes of steps S203 to S227 shown in the flow chart in FIG. 2.

Therefore, the processes from step S929 downward, which are different from the steps in FIG. 2, will be described. In step S929, communication unit (local) 325 is supplied with power that was stopped. That is, power-supply circuit 333 is controlled to turn on SW, and power is supplied from battery 335 to communication unit (local) 325.

When the power is supplied, in step S931, communication unit (local) 325 notifies parent device 300P of the occurrence of an abnormal condition. Then, in step S932, the process waits until a reset notification from parent device 300P is received. When the reset notification is received ("YES" in step S932), power-supply circuit 333 is controlled in step S933 to turn off SW, and the power-supply from battery 335 to communication unit (local) 325 is again stopped, and thereafter the process goes back to step S909 where e.g. various flags are initialized.

As such, on the child device 300C side, the process of detecting an opening/closing state of a bathroom or the like is performed, and also occurrence of an abnormal condition is determined in accordance with the detected result. Moreover, if it is determined that the abnormal condition has occurred, the process of notifying parent device 300P of the abnormality detection is also performed.

Figure 10:
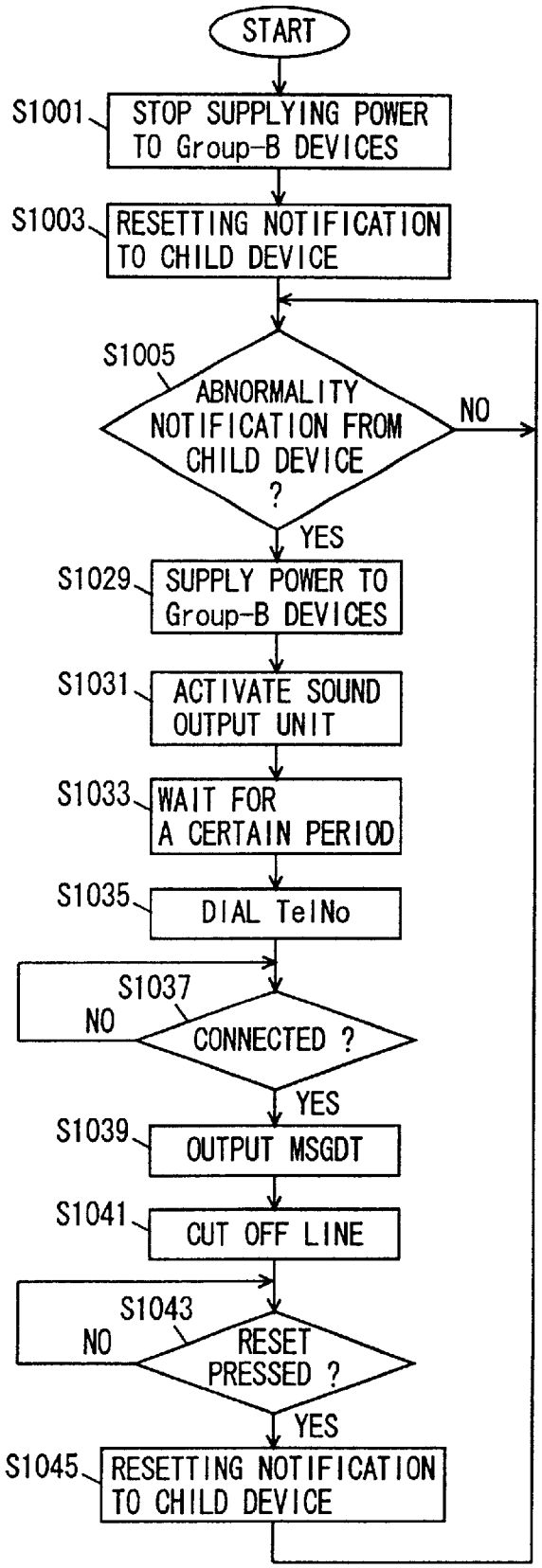
FIG. 10 is a flow chart showing the process flow of an abnormality notification control unit on a parent device side.

FIG. 10 is a flow chart showing the process flow of abnormality notification control unit 309 on the parent device side. Referring to FIG. 10, first, power button 317 is pressed by the user, power is supplied to the devices of Group-E from AC power-supply 319 to start activating abnormality notification control unit 309.

Abnormality notification control unit 309 stops the power supplied to the devices of Group-B in step S1001, and transmits in step S1003 a reset signal to child device 300C from resetting unit 327. Next, in step S1005, it is determined whether or not the abnormality detection notification is received from child device 300C. Then, the process waits until the abnormality detection notification is received by communication unit (local) 326.

When the notification for abnormality detection is received, the process moves on to step S1029. Thus, power is supplied to Group-B and the abnormality notification to the outside is performed. It is noted that the processes from steps S1029 to S1041 are similar to the processes from steps S229 to S241 in the flow chart shown in FIG. 2.

Thus, an alarming sound is emitted by sound output unit 313 (step S1031), and after a wait for a certain period of time (step S1033), an emergency call is made to TelNo (the telephone number for notification) (steps S1035, S1037). After telephone 10 is notified of the message informing that there is an abnormal condition (step S1039), the line is cut off (step S1041).

When the abnormality notification is sent to telephone 10, the process waits in step S1043 until the resetting signal is issued from resetting unit 327. That is, the process waits until the resetting operation is performed by the inhabitant himself/herself or a helper. Then, when the reset signal is issued, in step S 1045, child device 300C is notified of the issuance, and the process goes back to the process of step S1005.

Thus, in parent device 300P, when it receives the abnormality detection notification from a child device, it appropriately notifies the outside that an abnormal condition occurred.

Fourth Embodiment

Finally, an abnormal condition detecting system 400 according to the fourth embodiment of the present invention is described. The present system has a configuration similar to abnormal condition detecting system 100 according to the first embodiment shown in FIG. 1. However, there is a slight difference in controlling details at abnormality detection notification control unit 109.

In addition to the processes performed in abnormal condition detecting system 100 according to the first embodiment, the present system 400 also includes the process of checking the capacity of a battery. Thus, the process of checking the battery capacity as described below is added to the flow chart shown in FIG. 2.

Figure 11:
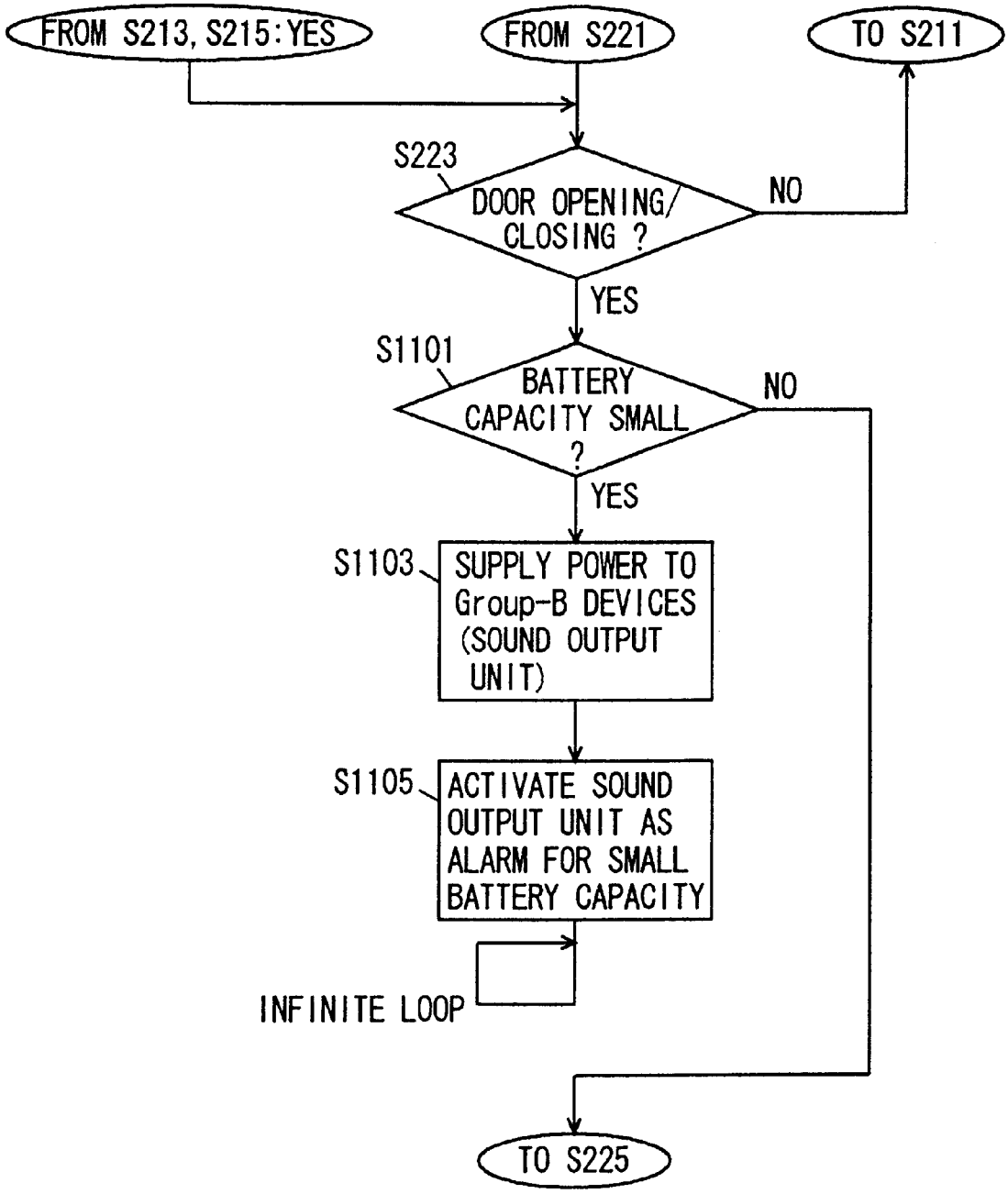
FIG. 11 is a flow chart showing the flow of the process of checking a battery capacity in an abnormal condition detecting system according to the fourth embodiment of the present invention.

FIG. 11 is a flow chart showing the process flow of checking the battery capacity of abnormal condition detecting system 400 according to the fourth embodiment of the present invention. The step S223 in FIG. 11 corresponds to the step S223 in FIG. 2. In step S223, if no door opening/closing is detected by door opening/closing detection unit 101, the process goes back to step S211 in FIG. 2, whereas if it is detected, the process moves on to step S1101.

In step S1101, it is determined whether or not the capacity of battery 121 is at a predetermined value or lower. If the battery capacity is larger than the predetermined value, the process moves on to step S225 in FIG. 2.

On the other hand, if the battery capacity is at a predetermined value or lower, the process goes on to step S1103, and the devices of Group-B are supplied with power. Then, in step S1105, an alarming sound is emitted by sound output unit 113. Sound output unit 113 continuous outputting the alarming sound until it runs out of the battery capacity unless the user (inhabitant) notices the alarming sound. It is noted that the user (inhabitant) can distinguish the alarming sound emitted here from the alarming sound emitted at the time of detection of an abnormality.

As such, checking of the battery capacity and outputting of the alarming sound are performed when the door opening/closing is detected. Detection of door opening/closing means that a presence of a user (inhabitant) is confirmed at the time point. Therefore, the warning for the shortage of battery capacity may surely be given to the user (inhabitant).

It is noted that battery 121 supplying power to Group-B is herein subjected to the check for its capacity in step S1101. However, it is not limited thereto, and battery 119 for supplying power to Group-A may also be checked for its capacity.

Furthermore, illustrated in the fourth embodiment is the system further performing the process of checking the battery capacity in addition to the processes performed in abnormal condition detecting system 100 configured as shown in FIG. 1. However, it is not limited thereto, and the additional process of checking the battery capacity may be applied to the abnormal condition detecting system shown in FIG. 3 or 8.

It is noted that abnormal condition detecting system 100 shown in FIG. 1 only uses batteries for supplying power. Abnormal condition detecting systems 200 and 300 respectively shown in FIGS. 3 and 8 each utilizes an AC power-supply for a part of the parent device and a battery for the other parts. However, it is not limited to such configuration patterns, and AC power-supply in place of a battery, or vice versa, may be used for supplying power. In particular, a large consumption power is required in order to emit an alarming sound or to notify the outside that the abnormal condition occurred, so that an AC power-supply may be used for Group-B in each of FIGS. 1, 3 and 8. This can avoid the problem of a shortage of the battery capacity.

In the embodiments described herein, an example where opening/closing of a bathroom door and an entrance door are detected was described as a method of detecting use frequency of home infrastructures. Detection of opening/dosing of the bathroom door is the most appropriate for detecting abnormal circumstances of an inhabitant, and detection of opening/dosing of an entrance door is appropriate for determining if the inhabitant is in or out. However, the present invention is not limited thereto, and may also be applied to any home infrastructure (equipment) such as a water faucet, the lid of a washing machine, the door of a refrigerator.

Furthermore, in the embodiments described herein, when an abnormal condition occurs, the same notification message MSGDT is transmitted to the telephone to be notified. However, for example, two types of such notification messages may be registered and selectively be used in accordance with whether or not STime is set by the user.

That is, when STime is set and the detection period is shortened, a message having a lower significance may be sent such as "there may be an emergency," and when no STime is set and the detection period is left as it is, a message having a higher significance may be transmitted such as "there is an emergency."

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An abnormal condition detecting system, comprising:

an acquisition unit acquiring information related to use of a home infrastructure in a residence;

a count unit counting a number of times a particular element of said home infrastructure is operated during a certain time period, based on said acquired information related to use, wherein said counted number of operations is reset at predetermined intervals and said certain time period is restarted at said predetermined intervals;

a determination unit determining whether or not said counted number of operations is at most a predetermined value; and a recognition unit recognizing an abnormal condition of a user using said home infrastructure when said determination unit determines that the counted number of operations is at most a predetermined value.

2. The abnormal condition detecting system according to claim 1, wherein said certain period is shorter than said predetermined interval.

3. The abnormal condition detecting system according to claim 1, further comprising:

a detection unit detecting operation of said particular element of said home infrastructure; and a first communication unit transmitting information related to said detected operation of the home infrastructure to said acquisition unit.

4. The abnormal condition detecting system according to claim 3, wherein when there are a plurality of said detection units, said first communication unit further transmits identification information for identifying each detection unit, and said recognition unit recognizes an abnormal condition of a user by further considering said transmitted identification information.

5. The abnormal condition detecting system according to claim 3, further comprising a first power-supply unit supplying power to said first communication unit, said first power-supply unit supplying power when said first communication unit performs transmission.

6. The abnormal condition detecting system according to claim 5, further comprising:

a first capacity determination unit determining whether or not there is a shortage of capacity in said first power-supply unit; and a first sound alarming unit alarming that there is the shortage of capacity when said first capacity determination unit determines that there is the shortage of capacity, said first sound alarming unit being activated when said detection unit detects said use of the home infrastructure.

7. The abnormal condition detecting system according to claim 3, further comprising a first power-supply unit supplying power to said first communication unit, said first power-supply unit providing a power-supply different from the power-supply provided for said detection unit.

8. The abnormal condition detecting system according to claim 1, further comprising a second communication unit transmitting information to the outside of a residence, said second communication unit transmitting to a predetermined destination that a user is in an abnormal condition, when said recognition unit recognizes an abnormal condition of a user.

9. The abnormal condition detecting system according to claim 8, further comprising a third communication unit transmitting the abnormal condition of the user recognized by said recognition unit to said second communication unit, said second communication unit receiving a transmitted result from said third communication unit and transmits to a predetermined destination that the user is in the abnormal condition.

10. The abnormal condition detecting system according to claim 9, further comprising:

a third power-supply unit supplying power to said third communication unit, said third power-supply unit supplying power when said third communication unit performs transmission.

11. The abnormal condition detecting system according to claim 10, further comprising:

a third capacity determination unit determining whether or not there is a shortage of capacity in said third power-supply unit; and a third sound alarming unit alarming that there is the shortage of capacity when said third capacity determination unit determines that there is the shortage of capacity, said third sound alarming unit being activated when said detection unit detects said operation of the particular element of the home infrastructure.

12. The abnormal condition detecting system according to claim 9, further comprising:

a third power-supply unit supplying power to said third communication unit, said third power-supply unit providing a power-supply different from the power-supply provided for said recognition unit.

13. The abnormal condition detecting system according to claim 8, further comprising a second power-supply unit supplying power to said second communication unit, said second power-supply unit supplying power when said communication unit performs transmission.

14. The abnormal condition detecting system according to claim 13, further comprising:

a second capacity determination unit determining whether or not there is a shortage of capacity in said second power-supply unit; and a second sound alarming unit alarming that there is the shortage of capacity when said second capacity determination unit determines that there is the shortage of capacity;

said second sound alarming unit being activated when said detection unit detects said operation of the particular element of the home infrastructure.

15. The abnormal condition detecting system according to claim 8, further comprising a second power-supply unit supplying power to said second communication unit, said second power-supply unit providing a power-supply different from the power-supply provided for said recognition unit.

16. The abnormal condition detecting system according to claim 1, wherein the particular element of said home infrastructure is a mechanical element that is operable to be opened and closed.

17. The abnormal condition detecting system according to claim 16, wherein the count unit counts the number of times that the mechanical element is opened or closed.

18. The abnormal condition detecting system according to claim 17, wherein the mechanical element is a door.

19. The abnormal condition detecting system according to claim 18, wherein the door is a bathroom door.

* * * * *